United States Patent [19]

Psiol et al.

[11] Patent Number: 5,016,884

[45] Date of Patent: May 21, 1991

[54] GOLF PUTTING GAME

[76] Inventors: Nick Psiol, 91 Twelveoak Hill Dr.; Mike Lucchesi, 27 Tan Oak Cir., both of, both fo San Rafael, Calif. 94903

[21] Appl. No.: 381,468

[22] Filed: Jul. 18, 1989

[51] Int. Cl.[5] ..... A63B 69/36

[52] U.S. Cl. ..... 273/176 FA; 273/176 B; 273/179 R; 273/179 C; 273/180; 273/182 A; 273/183 R

[58] Field of Search ..... 273/176 R, 176 B, 176 F, 273/176 FA, 176 FB, 179 R, 179 B, 179 E, 180, 181 R, 182 R, 182 A, 183 R

[56] References Cited

U.S. PATENT DOCUMENTS

| | | | |
|---|---|---|---|
| 3,114,554 | 12/1963 | Hurley | 273/179 B |
| 3,114,555 | 12/1963 | Hurley | 273/179 B |
| 3,184,239 | 5/1965 | Heuser | 273/176 FA |
| 3,424,463 | 1/1969 | Matthews | 273/180 |
| 3,588,117 | 6/1971 | Hertenstein | 273/176 FA |
| 3,986,718 | 10/1976 | Long et al. | 273/180 |
| 4,336,939 | 6/1982 | Krumlauf | 273/176 FB |
| 4,563,009 | 1/1986 | Nagasaki et al. | 273/179 B |
| 4,634,130 | 1/1987 | Simjian | 273/176 FA |

FOREIGN PATENT DOCUMENTS

| | | | |
|---|---|---|---|
| 24119 | 12/1929 | Australia | 273/176 F |

*Primary Examiner*—Edward M. Coven
*Assistant Examiner*—Raleigh W. Chiu
*Attorney, Agent, or Firm*—Leon Gilden

[57] ABSTRACT

A golf putting game is set forth wherein a forward platform horizontally disposed relative to an upper playing surface angularly oriented at an obtuse angle relative to an upper surface of the forward platform includes a series of target golf cup openings cooperating with one another by way of a common tunnel into a return channel. A backboard is spaced rearwardly of the playing surface by a rear trough that returns balls by means of a further channel generally coextensive with the playing surface and medially of the platform of the invention. A pivoted lever switch is oriented and spaced above biased contact points to indicate upon the backboard indication of a golf ball received within a respective cup and balls utilized in the game.

7 Claims, 1 Drawing Sheet

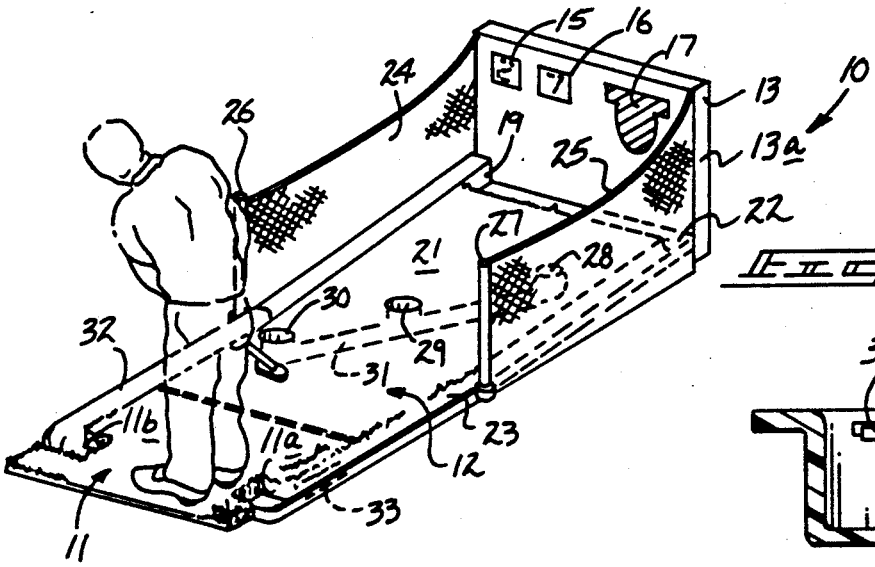
FIG 1
FIG 2
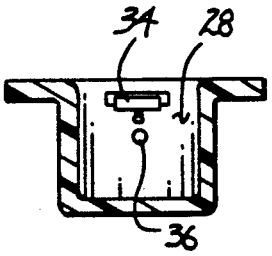
FIG 5
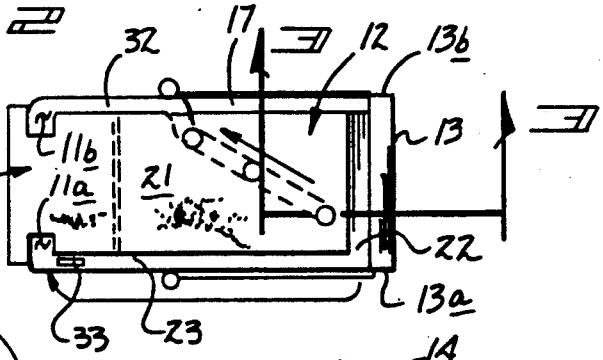
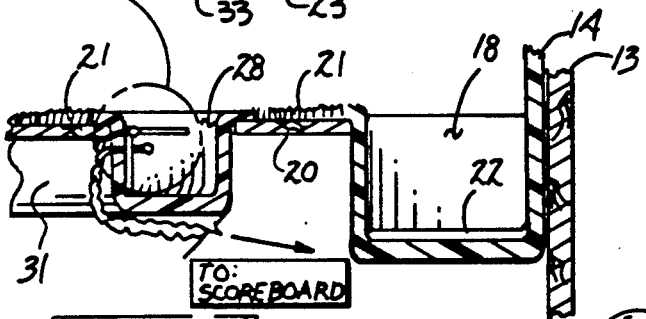
FIG 3
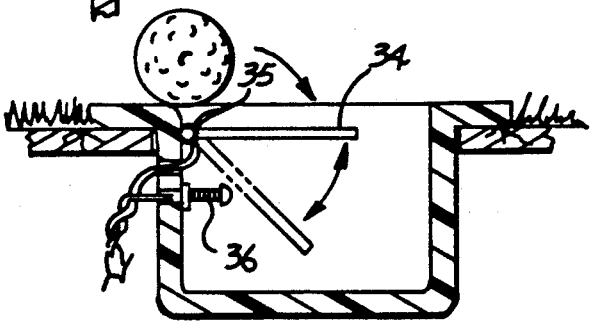
FIG 6
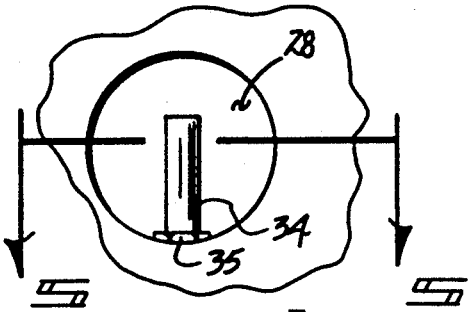
FIG 4

GOLF PUTTING GAME

BACKGROUND OF THE INVENTION

1. Field of the Invention

The field of invention relates to golf putting games, and more particularly pertains to a new and improved golf putting game wherein the same includes a series of target cups and ball returns, as well as a scoring means.

2. Description of the Prior Art

The use of golf-type games is well known in the prior art. Heretofore, the prior art has utilized various golf combinations to set forth and enhance various features of the playing and practicing of aspects of golf, such as putting, driving, etc. Examples of the prior art include U.S. Pat. No. 2,912,248 to Buono wherein a golf putting game includes a series of target cups and ball return channels therefore.

U.S. Pat. No. 1,799,263 to Swain, et al., provides a golf putting game with a driving platform, an intermediate portion, and a matrix of target cups wherein a positioning of a golf ball into one of the target cups will illuminate a certain light means behind the cups.

U.S. Pat. No. 3,424,463 to Matthews sets forth a golf putting game indicating the use of a ball return and scoring indicator for the return.

U.S. Pat. No. 3,844,558 to Gigliotti sets forth a golf game providing a golf ball rebounding from a vertically positioned target panel to enable the golf ball to be directed within an underlying panel containing target cups.

U.S. Pat. No. 3,843,136 to Buenzle sets forth a golf putting apparatus utilizing targets with various scoring awards associated with the directing of the golf ball into an associated target.

As such, it may be appreciated that there is a continuing need for a new and improved golf putting game wherein the same addresses both the problems of ease of use and effectiveness in construction, and in this respect, the present invention substantially fulfills this need.

SUMMARY OF THE INVENTION

In view of the foregoing disadvantages inherent in the known types of golf putting games now present in the prior art, the present invention provides a golf putting game wherein the same utilizes various golf cup targets and switch means within targets for providing indication of scoring in the play of the game. As such, the general purpose of the present invention, which will be described subsequently in greater detail, is to provide a new and improved golf putting game which has all the advantages of the prior art golf putting games and none of the disadvantages.

To attain this, the present invention comprises a forward horizontal surface and obtusely oriented playing surface wherein the playing surface includes a series of target golf cups of various scoring awards associated with each cup. A single tunnel intercommunicates each of the cups and wherein each cup includes an overlying switch lever positioned underlying an upper edge of the cup a distance less than the radius of an associated golf ball with contact points positioned underneath the lever such that a carom shot that is directed exteriorly of the cup will not actuate a point score within that cup as the lever must deflect a predetermined amount to contact the underlying contact points. A plurality of ball return channels are provided for return of a golf ball from a cup scoring position and from a rearwardly positioned trough of the playing surface for a non-scoring golf ball.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf putting game which has all the advantages of the prior art golf putting games and none of the disadvantages.

It is another object of the present invention to provide a new and improved golf putting game which may be easily and efficiently manufactured and marketed.

It is a further object of the present invention is to provide a new and improved golf putting game which is of a durable and reliable construction.

An even further object of the present invention is to provide a new and improved golf putting game which is susceptible of a low cost of manufacture with regard to both materials and labor, and which accordingly is then susceptible of low prices of sale to the consuming public, thereby making such golf putting games economically available to the buying public.

Still yet another object of the present invention is to provide a new and improved golf putting game which provides in the apparatuses and methods of the prior art some of the advantages thereof, while simultaneously overcoming some of the disadvantages normally associated therewith.

Still another object of the present invention is to provide a new and improved golf putting game wherein a plurality of target cups are provided of various point scores to indicate positioning of a golf ball within a predetermined cup.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is a top orthographic view of the instant invention.

FIG. 3 is an orthographic view taken along the lines 3—3 of FIG. 2 in the direction indicated by the arrows.

FIG. 4 is a top orthographic view of a target cup.

FIG. 5 is a cross-sectional orthographic view taken along the lines 5—5 of FIG. 4 in the direction indicated by the arrows.

FIG. 6 is a cross-sectional side view of the target cup as set forth in Section 6 of FIG. 3.

DESCRIPTION OF THE PREFERRED EMBODIMENT

With reference now to the drawings, and in particular to FIGS. 1 to 5 thereof, a new and improved golf putting game embodying the principles and concepts of the present invention and generally designated by the reference numeral 10 will be described.

More specifically, the golf putting game 10 of the instant invention essentially comprises a horizontally disposed forward platform 11 including respective first and second ball return troughs 11*a* and 11*b* directed interiorly of opposed sides of the platform 11. Extending forwardly from a forward edge of the forward platform 11 is an elongate playing surface 12 of a generally rectangular configuration sloping upwardly at an obtuse angle relative to an upper surface of the respective forward platform 11 and playing surface 12 with a backboard 13 vertically disposed and spaced from a rear elongate edge of the playing surface 12 to define a rear ball return trough 18. The backboard 13 is formed with a right side wall 13*a* and a left side wall 13*b* with a first score keeping panel 15 utilizing light emitting diode scoring enumeration of conventional and well known construction and includes a protective polymeric coating 14 about its forward face. A second score panel 16 indicates the number of balls utilized by a player. A logo panel 17 spaced adjacent the first and second ball scoring panels is provided for utilization of advertising material. The rear trough 18 is formed and originates against an abutment wall 19 that is coplanar with a side wall of the playing surface 12 and includes a sloping floor 22 that slopes from the abutment wall 19 downwardly towards the right side wall 13*a* of the backboard 13 and is directed into a first "L" shaped return channel 23 extending from the backboard 11 to a position interiorly of the platform 12 defined as the first ball return trough 11*a*.

The forward platform 11 and the playing surface 12 are formed with a rigid, planar base 20 with an overlying turf covering 21 formed of artificial fiber to simulate an exterior grass covered putting surface. Positioned coextensively and adjacent each side of the playing surface 12 terminating short of the forward edge of the playing surface 12 are nets including a first net 24 and a second net 25 secured at the rearward ends to the right and left side walls 13*a* and 13*b* and are of a height substantially equal to the side walls 13*a* and 13*b* and terminate forwardly and secured to respective first and second rigid posts 26 and 27, wherein the posts 26 and 27 are of a height less than that of the right and left side walls 13*a* and 13*b* to form a trapezoidal net configuration to accommodate misdirected golf balls struck by an individual.

The playing surface 12 includes a series of three target cups including first target cup 28, second target cup 29, and third target cup 30 of a diameter greater than that of an associated golf ball "G" and are disposed with upper edges coextensive with the artificial fiber turf covering 21. Each of the target cups 28, 29, and 30 are interconnected by communicating tunnel 31 of a diameter greater than that of an associated golf ball "G" and slope downwardly towards a second "L" shaped return channel 32 that terminates in the second ball return trough 11*b*. A contact pressure switch pad 33 is positioned adjacent the first ball return trough 11*a* within the first return channel 23 to indicate the passage of a ball thereover. Each of the target cups 28, 29, and 30 includes an elongate lever plate 34 that is pivotally biased in a horizontal orientation relative to a bottom surface of each associated cup to cooperate with the spaced spring-biased contacts 36. The elongate lever plate 34 is spaced below an upper edge of an associated cup a distance less than that of a radius of an associated golf ball "G", whereupon a caromed golf ball that does not enter the associated target cup will not deflect the associated target lever plate 34 a sufficient distance to enable the metallic lever plate 34 to effect electrical communication with the associated spring-biased contacts 36, as illustrated in FIG. 3 in the downwardly deflected orientation illustrated in phantom. The lever plate 34 must be deflected a sufficient amount to effect contact with the spring-biased contacts and upon a golf ball "G" entering an associated cup, the spring-biased contacts will deflect to permit the lever plate 34 to pivot a sufficient amount to enable the golf ball "G" to enter an associated cup and subsequently be directed through the intercommunicating tunnel 31 to enable the golf ball to be directed to a second "L" shaped return channel 32. The contact of an associated lever plate 34 with its contacts 36 will effect a scoring upon the associated panels 15 and 16 by indicating a predetermined score and that a ball has been utilized. In the playing of the game, nine balls are utilized wherein a score of five points is awarded for an individual directing a golf ball through the first target cup 28, with three points awarded for directing a golf ball into the second target cup 29, with one point awarded for a golf ball directed into the third target cup 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf putting apparatus comprising, in combination, a golf ball of a predetermined diameter, and a planar first platform, and an elongate forward second platform fixedly secured to a forward edge of the first platform sloping upwardly at an obtuse included angle relative to the first platform, and a vertically disposed backboard of a predetermined height spaced beyond a forward edge of the second platform, and a return trough spaced below the forward edge of the second platform, and an abutment wall orthogonally disposed across the forward trough at a first end of the forward trough with the abutment wall aligned with the left side of the second platform wherein the forward trough includes a sloping floor directed from the abutment wall to a second end adjacent a right side of the backboard in communication with a first ball return channel arranged coextensively adjacent a right side of the second platform and the first platform, and a plurality of target cups positioned within the second platform, and a single tunnel in communication between the target cups and a second ball return channel arranged adjacent a left side of the second platform and the first platform, and a first switch member arranged within each target cup to indicate a predetermined point score awarded, and a first indicator panel arranged in a forward face of the backboard to indicate the point award.

2. A golf putting apparatus as set forth in claim 1 including a second indicator panel arranged adjacent the first indicator panel to indicate a number of balls utilized and directed through the target cups and the first ball return channel.

3. A golf putting apparatus as set forth in claim 2 wherein a second switch member is arranged along a floor of the first ball return channel to indicate a golf ball directed thereover.

4. A golf putting apparatus as set forth in claim 3 wherein the first ball return channel terminates in a first ball return trough directed interiorly of the horizontal platform and the second ball return channel terminates in a second ball return trough directed in alignment with the first ball return trough interiorly of the horizontal platform.

5. A golf putting apparatus as set forth in claim 4 wherein the first switch member includes an elongate lever plate hingedly mounted, including a spring hinge to secure a rear end of the lever plate to a wall of a respective target cup wherein a lever plate length is less than a diameter defined by each target cup.

6. A golf putting apparatus as set forth in claim 5 further including at least one spring-biased contact arranged underlying the lever plate and spaced therefrom for electrical communication with the lever plate when the lever plate is pivoted downwardly when a golf ball is directed into a respective target cup.

7. A golf putting apparatus as set forth in claim 6 including a first net arranged and secured between a left side of the backboard and a first post disposed adjacent a forward end of the second ball return channel, and a second net arranged between the right side of the backboard and of a second net length equal to a first net length defined by the first net, and wherein the first and second nets are secured coextensively with the respective right and left sides of the backboard and the first and second nets slope downwardly to the respective first and second posts wherein the first and second posts are of a first and second post height less than that of a predetermined height of the backboard.

* * * * *